United States Patent [19]

Bible

[11] Patent Number: 5,060,955

[45] Date of Patent: Oct. 29, 1991

[54] GAME APPARATUS AND ASSOCIATED PLAYING METHOD

[76] Inventor: George R. Bible, 1412 Belleville Ave., Maryville, Tenn. 37801

[21] Appl. No.: 574,058

[22] Filed: Aug. 29, 1990

[51] Int. Cl.[5] ..... A63B 67/06

[52] U.S. Cl. ..... 273/400

[58] Field of Search ..... 273/400, 401, 402

[56] References Cited

U.S. PATENT DOCUMENTS

| | | | |
|---|---|---|---|
| 441,099 | 11/1890 | Hoyt . | |
| 1,114,523 | 10/1914 | Reveli . | |
| 3,990,703 | 11/1976 | Evans . | |
| 4,169,596 | 10/1979 | Chinenson | 273/401 |
| 4,204,682 | 5/1980 | Brown | 273/401 |
| 4,565,375 | 1/1986 | Dresel | 273/401 |

*Primary Examiner*—William H. Grieb

*Attorney, Agent, or Firm*—Pitts & Brittian

[57] ABSTRACT

A game apparatus and associated playing method. The game apparatus comprises two cup members, each cup member defining a cavity therein and having an upper portion defining an opening accessing the cavity. Each cup member is provided at its upper end portion with an outwardly disposed flange defining an upper surface, and when in use the cup members are recessed into the playing surface such that the upper surface of the flange is substantially level with the playing surface. The game apparatus also includes a plurality of pucks for being tossed at the cup members. In accordance with the playing method of the present invention the cup members are placed a preselected distance apart, and opposing players toss a selected number of pucks, alternately, at one cup member and then the other from a position behind the cup member not being targeted. A first scoring value is assigned to pucks which come to rest in the cavity of the targeted cup member. A second scoring value is assigned to the puck which come to rest on the flange of the targeted cup member and which is the closest puck to the opening of such cup member resting on the flange. A third scoring value is assigned to at least the one puck not otherwise assigned a scoring value, which comes to rest within an outer target perimeter and which is the closest to the opening in the targeted cup member without being received in the cavity of the cup member.

17 Claims, 3 Drawing Sheets

GAME APPARATUS AND ASSOCIATED PLAYING METHOD

TECHNICAL FIELD

This invention relates to a game apparatus and an associated playing method. In this particular invention the game apparatus includes a pair of cup members at which pucks are thrown, and scoring values are assigned to the pucks tossed at the cup members based upon the accuracy of the toss.

BACKGROUND ART

Games in which objects are tossed toward targets to test the skill of the tossing player are well known in the art. Examples of certain known games are disclosed in U.S. Pat. Nos. 441,099; 1,114,523; and 3,990,703. However, tossing games can quickly become tiresome unless the game truly challenges the skill of the players, and unless the game features a scoring system which accurately rewards the players in accordance with their skill.

Therefore, it is an object of the present invention to provide an improved game apparatus and associated game playing method.

It is another object of the present invention to provide a game apparatus and associated playing method which challenges the tossing skill of the players.

Yet another object of the present invention is to provide a game playing method which has a unique scoring system which accurately rewards the players in accordance with their tossing skill.

Still another object of the present invention is to provide a game apparatus which includes components which are inexpensive, yet durable.

DISCLOSURE OF THE INVENTION

Other objects and advantages will be accomplished by the present invention which provides a game apparatus and associated playing method. The game apparatus comprises at least one, and preferably two, cup members, each cup member defining a cavity therein and having an upper portion defining an opening accessing the cavity. Each cup member is provided at its upper end portion with an outwardly disposed flange defining an upper surface, and when in use the cup members are recessed into said playing surface such that the upper surface of the flange is substantially level with the playing surface. The game apparatus also includes a plurality of pucks for being tossed at the cup members from a preselected distance.

In accordance with the playing method of the present invention the cup members are placed a preselected distance apart, and opposing players toss a selected number of pucks, alternately, at one cup member and then the other from a position behind the cup member not being targeted. A first scoring value is assigned to pucks which come to rest in the cavity of the targeted cup member and the player tossing such a puck is credited with such first scoring value. A second scoring value is assigned to the puck which come to rest on the flange of the targeted cup member and which is the closest puck to the opening of such cup member to rest on the flange, and the player tossing the puck is credited with the second scoring value. Further, a third scoring value is assigned to at least the one puck not otherwise assigned a scoring value, which comes to rest within an outer target perimeter and which comes to rest the closest to the opening in the targeted cup member without being received in the cavity of the cup member, and the player tossing such puck is credited with the third scoring value. An upper limit is set on the total scoring value necessary to win the game.

BRIEF DESCRIPTION OF THE DRAWINGS

The above mentioned features of the invention will be more clearly understood from the following detailed description of the invention read together with the drawings in which.

BEST MODE FOR CARRYING OUT THE INVENTION

Figure 1:
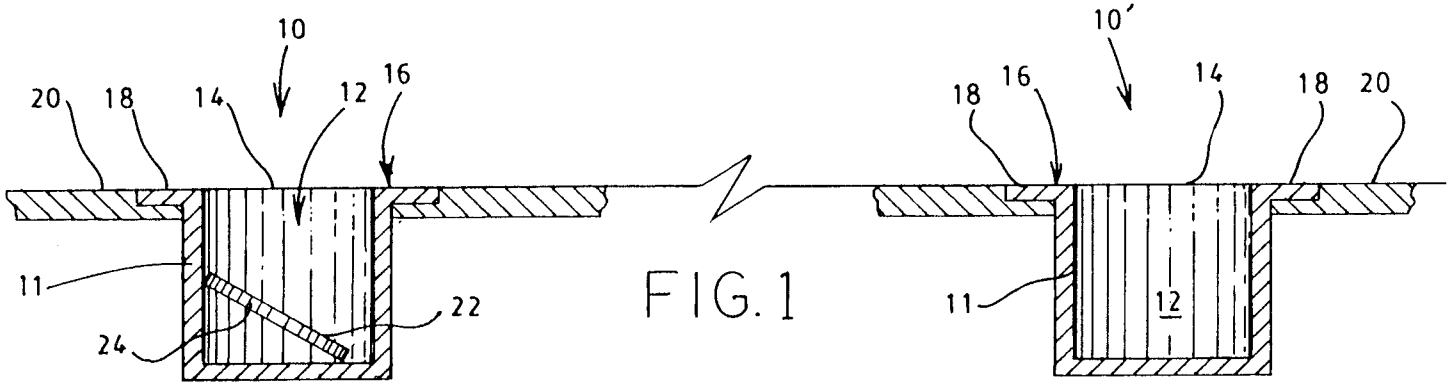
FIG. 1 illustrates a side elevation view, in section, of the game apparatus of the present invention.

In the preferred embodiment illustrated in the Figures, the game apparatus of the present invention comprises at least one, and preferably first and second cup members 10 and 10', respectively. Each of the cup members 10 and 10' defines a cavity 12 therein, with an upwardly disposed opening 14 accessing the cavity 12. In the preferred embodiment each cup member defines a cylindrical configuration, with the cylinder portion 11 of the cup member having a diameter of approximately two and one half inches. However, the cup members can define other geometric configurations and/or sizes if desired, and the cylindrical shape of the cup members 10 and 10' is merely illustrative of one preferred embodiment.

Each of the cup members 10 and 10' is also provided with an outwardly disposed flange 16 which circumscribes the opening 14, and which defines a substantially planar upper surface 18. In the preferred embodiment the flanges 16 are approximately one half inch wide, but this width can be vary if desired. Further, the cup members 10 and 10', are preferably fabricated of a strong durable plastic, but it will be appreciated that other durable fabricating materials can be used.

As illustrated in FIG. 1, the cup members 10 and 10' are designed to be recessed in the ground or other supporting structure such that the upper surface 18 of the flange 16 of each cup member 10 and 10' is substantially coplanar with the playing surface 20. Further, when the game apparatus is being used the two cup members 10 and 10' are spaced from one another a preselected distance. In this regard, in the preferred embodiment the cup members 10 and 10' are disposed such that the distance between the axes of the cylinder portions 11 of the cup members is approximately 20 feet.

The game apparatus of the present invention also includes a plurality of disks, or pucks 22 for being tossed at, and, desirably, into, the cup members 10 and 10'. Preferably the pucks 22 are fabricated of metal and approximately the size of a U. S. silver dollar. However, the size of the pucks 22 can be altered if desired, as long as the size of the pucks is such that they can be received in the cavities 12 of the cup members 10 and 10'. Further, the pucks 22 are provided with annular edges 22 which are knurled to facilitate the grasping and tossing of the pucks 20. As will be discussed below, the pucks 22 are allocated between opposing players, and, in the preferred embodiment, pucks 22 of at least two different colors are provided, or other suitable indicia means is provided, for distinguishing the pucks 22 of the opposing players.

Figure 2:
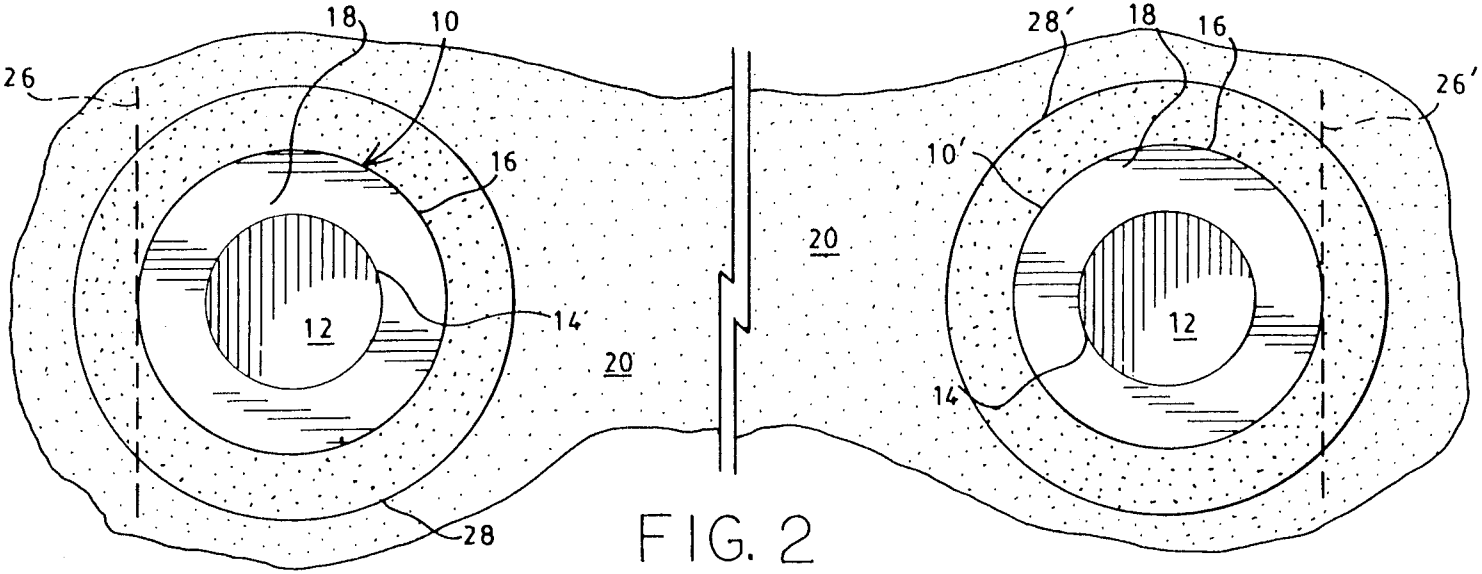
FIG. 2 illustrates a top view of the game apparatus of the present invention.

In accordance with the method of the present invention, players are required to toss the pucks 22 at the cup member 10 or 10' from a selected distance, and are awarded points depending upon the accuracy of the toss. More specifically, in the preferred application of the playing method of the present invention, when tossing pucks 22 at the first cup member 10, a player must be positioned behind the second cup member 10', i.e. on the opposite side of the second cup member 10' relative to the position of the first cup member 10 And, when tossing pucks 22 at the second cup member 10', a player must be positioned behind the first cup member 10, i.e. on the opposite side of the first cup member 10 relative to the position of the cup member 10'. Thus, as illustrated in FIG. 2, first and second foul lines 26 and 26', respectively, are established, and if a player steps over the foul line, or if the players feet extend over the foul line, during a toss, no score is credited for the toss and the toss cannot be remade. Of course, the foul lines can be marked using chalk or some other indicia means if desired, or the players can simply use the edge of the flanges 16 of the cups 10 and 10' as references to indicate the foul lines.

A players turn consists of the throwing of a preselected number of pucks 22, typically 3 pucks, at one of the cup members 10 or 10'. The determination of which player tosses first can be accomplished by the players making a preliminary toss at one of the cup members 10 or 10', and allowing the player whose puck lands closest to the opening 14, or in the cavity 12, of the targeted cup member to toss first. However, other suitable means can be used to determine which player takes the first turn.

After the first player has taken his turn and thrown his or her pucks, the opposing player takes his or her turn, and the players travel to the targeted cup member 10 or 10' to tally the score. As indicated above, the scoring is predicated on the accuracy of the toss. In this regard, a first, maximum number of points, typically 5 points, is awarded for a toss in which the puck 22 goes into the cavity 12 of the targeted cup member 10 or 10'. However, if the opposing player also tosses a puck 22 into the cavity, the two pucks cancel one another and neither player is awarded points.

A second, lesser number of points, typically 3 points, is awarded where the puck 22 overlays a portion of the upper surface 20 of the flange 16 of the targeted cup member 10 or 10', but, if more than one puck 22 lands on the flange 16, only the player whose puck 22 landed closest to the opening 14 is awarded three points.

A third, minimum amount of points, typically 1 point, is awarded to the player whose puck lands closest to the opening 14 of the targeted cup member, exclusive of a puck 22 which has been awarded 3 points for being the closest puck to land on the flange 16. Further, indicia means can be provided to define the outer target perimeters 28 and 28' as illustrated in FIG. 2, whereby pucks 22 landing outside of the perimeter 28 or 28' are awarded no points. Of course, the perimeters 28 and 28' can be defined by chalk or other indicia means. Further, whereas the diameter of the target perimeters 28 and 28' can be varied, typically the radial distance between the outer edges of the flanges 16 and the perimeters 28 and 28' is approximately 6 inches. It will be noted that in FIG. 2 the diameters of the perimeters 28 and 28' relative the diameters of the cup members have been reduced for illustrative purposes, and FIGS. 3 and 4 illustrate a closer representation of the preferred relative diameters.

Figure 3:
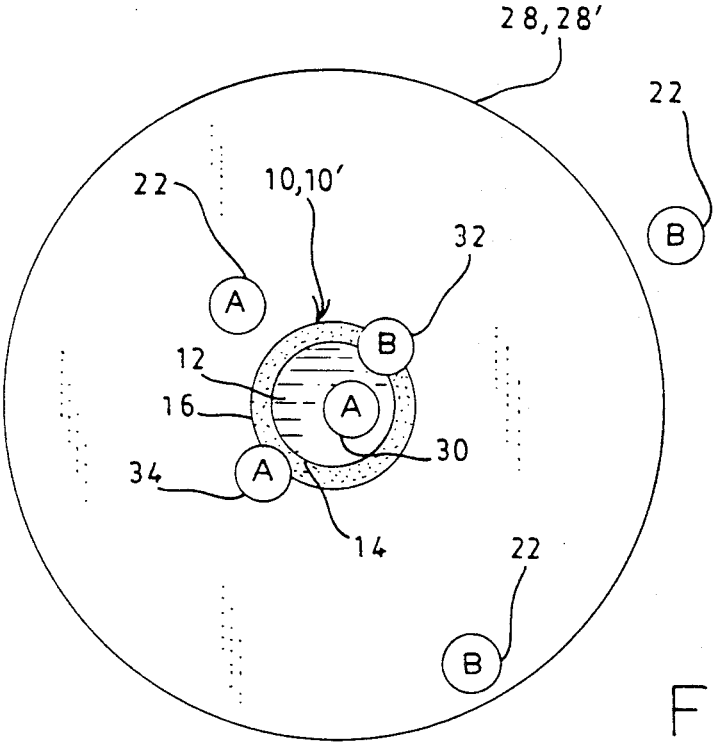
FIG. 3 illustrates a diagrammatic top view of the game apparatus of the present invention.
Figure 4:
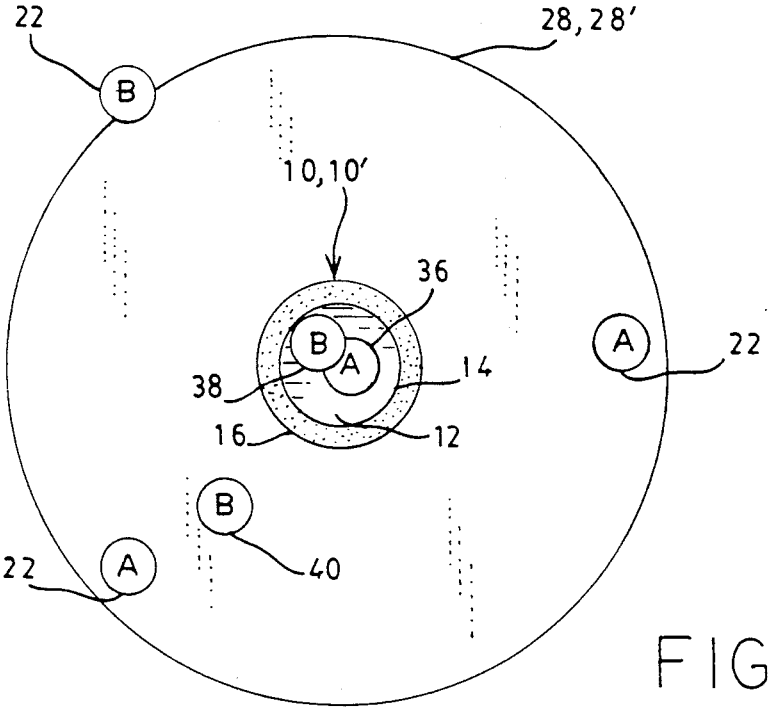
FIG. 4 illustrates a diagrammatic top view of the game apparatus of the present invention.

In FIGS. 3 and 4 examples of puck dispositions after two opposing players have take their turns are diagrammatically illustrated. The pucks 22 are marked with the indicia "A" for player A and "B" for player B. It will be noted that in FIG. 3 the puck 30 has been tossed into the cavity 12 and player A is entitled to 5 points for this puck. Both puck 32 and puck 34 have landed on the flange 16, but puck 32 is the closest to the center of the cup 10, 10', and therefore only player B is credited with a 3 point score. However, Player A is awarded 1 point for puck 34 since it is the closest of the remaining pucks. Resultantly, in FIG. 3, player A's score is 6 points and player B's score is 3 points.

In FIG. 4 both players have tossed pucks into the cavity !2, the pucks being referenced at 36 and 38. Therefore, neither player is credited with points. Further, no player has tossed a puck onto the flange 16, and, thus, no 3 point score is awarded. However, puck 40 is the closest puck to the cup member 10 and player B is entitled to 1 point for puck 40. Accordingly, in FIG. 4, player B is awarded one point and player A receives no points.

After the score for each player's first turn is tallied the players then toss from behind the previously targeted cup member 10, 10', at the cup member 10, 10', behind which pucks were tossed during the first turn, and the game continues with the players alternating targeted cup members on each turn. Of course, a maximum score is set for determination of the winner of the game. In the preferred application of the method of the present invention the first player to be awarded 21 points is the winner, but the player must win by two points. Thus, if at the end of a turn player A's score is 21 and player B's score is 20, no winner is declared and the game continues until one of the players has a two point advantage over the other player.

It will be recognized that the number of players can vary. For example, a game of "doubles" with two opposing teams of two players each can be expeditiously played by having a player from each team positioned at the first cup member 10 and targeting the second cup member 10', while the other two opposing players are positioned at the second cup member 10', and targeting the first cup member 10. After all four players have had their turn tossing their respective pucks 22, the players reverse positions in order to tally the score and, thereafter, to take their next turn.

Figure 5:
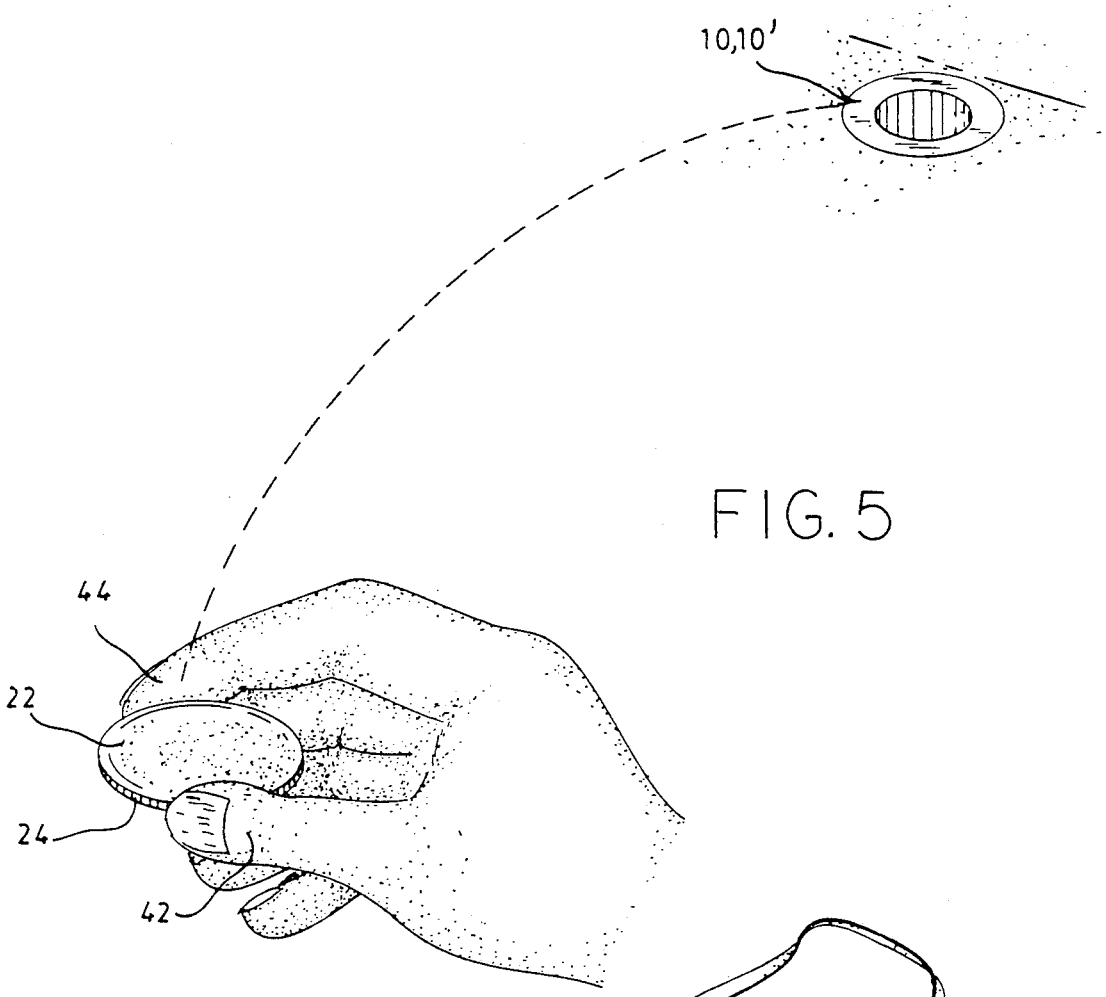
FIG. 5 illustrates a perspective view of the game apparatus of the present invention.

It will be understood that the tossing style or manner used to toss the pucks 22 can vary from player to player. However, as illustrated in FIG. 5, one style which has proven successful is to hold the puck 22 between the thumb 42 and the forefinger 44, and allow the puck to roll off the forefinger 44 as the puck is tossed. Due, at least in part, to the knurled edge 24, a stabilizing spin is produce whereby the puck spins about its axis as it flies toward the targeted cup member 10, 10'. The resulting stability of flight of the puck greatly enhances the accuracy of the toss.

Figure 6:
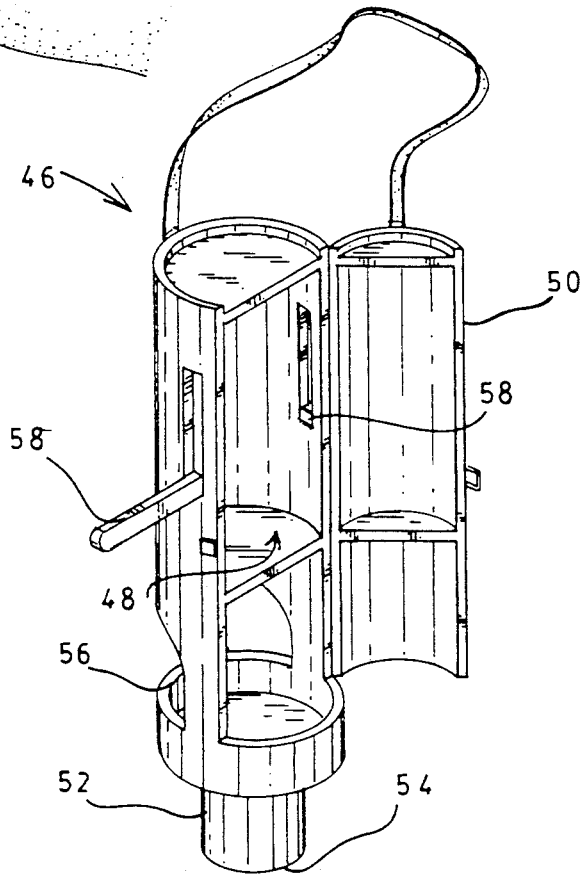
FIG. 6 illustrates a perspective view of the carrying case of the game apparatus of the present invention.

Referring now to FIG. 6, the game apparatus of the present invention can also include a carrying case 46 for holding the cup members 10 and 10' and pucks 22 when not in use or when being transported. In this regard, the case 46 defines a compartment 48 for receiving the game components, the compartment 48 being accessed by a suitable closure, such as the door 50. At the lower end portion of the case 46 a downwardly disposed annular cutting blade 52 is provided to facilitate the cutting of the holes necessary to recess the cup members 10 and 10' in the ground. Accordingly, the cutting blade 52 defines substantially the same diameter as the cylinder portions 11 of the cup members 10 and 10', and defines a cavity 54 within the perimeter of the blade 52 for receiving the earth to be displaced.

In order to facilitate the forcing of the blade 52 into the ground a foot engaging means is provided. In this regard, in the preferred embodiment such means includes an aperture 56 provided in the case 46 for receiving the foot of the user, whereby the users foot can be used to engage the case and force the blade into the ground. Handle means can also be provided, such as the illustrated handles 58 which are hinged to fold out from the sides of the case, to facilitate the grasping of the case with the users hands, and, thus, to facilitate the forcing of the blade 52 into the ground.

In light of the above it will be recognized that the present invention provides a game apparatus and associated playing method having great advantages over the prior art. However, while a preferred embodiment has been shown and described, it will be understood that there is no intent to limit the invention to such disclosure, but rather it is intended to cover all modifications and alternate constructions falling within the spirit and scope of the invention as defined in the appended claims.

I claim:

1. A game apparatus for being used out of doors and utilizing the surface of the ground as an associated playing surface, said game apparatus comprising:

at least one cup member, said cup member defining a cavity therein and having an upper portion defining an opening accessing said cavity, said cup member being provided at said upper end portion with an outwardly disposed flange defining an upper surface, whereby said cup member can be recessed into said playing surface such that said upper surface of said flange is substantially level with said playing surface;

a plurality of pucks for being tossed at said cup member from a preselected distance; and wherein said cavity of said cup member defines a first scoring area operatively associated with a first scoring value and said upper surface of said flange defines a second scoring area operatively associated with a second scoring value.

2. The game apparatus of claim 1 wherein said apparatus comprises a first and second said cup member and further comprises a carrying case for storing and transporting said cup members and said pucks, said carrying case being provided with cutting blade means for cutting a hole in said playing surface into which said first and second cup members are received.

3. A game apparatus for playing a game on a playing surface, said game apparatus comprising:

first and second cup members, each said cup member defining a cavity therein and having an upper portion defining an opening accessing said cavity, each said cup member being provided at said upper end portion with an outwardly disposed flange defining an upper surface, whereby said cup members can be recessed into said playing surface such that said upper surface of said flange is substantially level with said playing surface;

a plurality of pucks for being tossed at said cup members from a preselected distance; and a carrying case for storing and transporting said cup members and said pucks, said carrying case being provided with cutting blade means for cutting a hole in said playing surface into which said first and second cup members are received.

4. The game apparatus of claim 3 wherein said apparatus further comprises indicia means for defining an outer target perimeter about, and a selected radial distance from, said cup member.

5. The game apparatus of claim 3 wherein said pucks define annular disks fabricated of metal.

6. The game apparatus of claim 5 wherein said pucks define knurled annular edge portions.

7. The game apparatus of claim 3 wherein said pucks include a first group of said pucks of a first color and a second group of said pucks of a second color for differentiating said pucks of opposing players.

8. A game playing method for being played out of doors by at least one player and utilizing the surface of the ground as a playing surface, said method utilizing game apparatus including at least one cup member, said cup member defining a cavity therein and having an upper portion defining an opening accessing said cavity, said cup member being provided at said upper end portion with an outwardly disposed flange defining an upper surface, said cup member being buried in the ground such that said upper surface of said flange is substantially level with said playing surface, and including a plurality of pucks, said playing method comprising the steps of:

tossing a plurality of said pucks at said cup member from a preselected distance;

assigning a first scoring value to said pucks tossed at said cup member which come to rest in said cavity of said cup member;

assigning a second scoring value to said pucks tossed at said cup member which come to rest on said upper surface of said flange of said cup member, said second scoring value being a lesser value that said first scoring value; and assigning a third scoring value to at least the one said puck tossed at said cup member, and not otherwise assigned a scoring value, which comes to rest the closest to said opening in said cup member without being received in said cavity of said cup member.

9. The game playing method of claim 8 wherein said selected number of pucks tossed by said player at said cup member is three.

10. The game playing method of claim 8 wherein said first scoring value is five points, said second scoring value is three points, and said third scoring value is one point.

11. A game playing method for being played out of doors by at least first and second opposing players and utilizing the ground surface as a playing surface, said method utilizing game apparatus including at least a pair of cup members, each said cup member defining a cavity therein and having an upper portion defining an opening accessing said cavity, each said cup member being provided at said upper end portion with an outwardly disposed flange defining an upper surface, said cup members being selectively spaced from one another and buried in the ground such that said upper surface of said flange is substantially level with said playing surface, said game apparatus also including indicia means defining an outer target perimeter about said each said cup member and including a plurality of pucks, said playing method comprising the steps of:

each said first and second opposing player tossing a selected number of said pucks at said first cup member from a preselected distance;

assigning a first scoring value to said pucks tossed at said first cup member which come to rest in said cavity of said first cup member and crediting said player tossing said puck with said first scoring value;

assigning a second scoring value to said puck tossed at said first cup member which come to rest on said upper surface of said flange of said first cup member and which is the closest said puck member to said opening of said first cup member coming to rest on said upper surface of said flange, and crediting said player tossing said puck with said second scoring value, said second scoring value being a lesser value than said first scoring value; and assigning a third scoring value to at least the one said puck tossed at said first cup member and not otherwise assigned a scoring value, which comes to rest within said outer target perimeter and which comes to rest the closest to said opening in said first cup member without being received in said cavity of said first cup member, and crediting said player tossing said puck with said third scoring value, said third scoring value being a lesser value than said second scoring value.

12. The game playing method of claim 11 wherein one said puck tossed into said cavity of said first cup member by said second opposing player negates the assignment of said first scoring value to one said puck tossed into said cavity of said first cup member by said first opposing player, and neither of said players is credited with said first scoring value on the basis of the two said pucks being received in said cavity of said first cup member.

13. The playing method of claim 11 wherein said method comprises the further steps of:

each said first and second opposing player tossing a selected number of said pucks at said second cup member from a preselected distance;

assigning said first scoring value to said pucks tossed at said second cup member which come to rest in said cavity of said second cup member and crediting said player tossing said puck with said first scoring value;

assigning said second scoring value to said puck tossed at said second cup member which come to rest on said upper surfacer of said flange of said second cup member and which is the closest said puck member to said opening of said second cup member coming to rest on said upper surface of said flange, and crediting said player tossing said puck with said second scoring value; and assigning said third scoring value to at least the one said puck tossed at said second cup member and not otherwise assigned a scoring value, which comes to rest within said outer target perimeter and which comes to rest the closest to said opening in said second cup member without being received in said cavity of said second cup member, and crediting said player tossing said puck with said third scoring value.

14. The game playing method of claim 13 wherein one said puck tossed into said cavity of said first cup member by said second opposing player negates the assignment of said first scoring value to one said puck tossed into said cavity of said first cup member by said first opposing player, and neither of said players is credited with said first scoring value on the basis of the two said pucks being received in said cavity of said first cup member, and wherein one said puck tossed into said cavity of said second cup member by said second opposing player negates the assignment of said first scoring value to one said puck tossed into said cavity of said second cup member by said first opposing player, and neither of said players is credited with said first scoring value on the basis of the two said pucks being received in said cavity of said second cup member.

15. The game playing method of claim 14 wherein puck tosses directed at said first cup member must be made by said opposing players from a position on the opposite side of said second cup member from said first cup member if said puck tosses are to be assigned a score, and wherein puck tosses directed at said second cup member must be made by said opposing players from a position on the opposite side of said first cup member from said second cup member if said puck tosses are to be assigned a score.

16. The game playing method of claim 15 wherein said selected number of pucks tossed by each said first and second opposing player at said first cup member is three.

17. The game playing method of claim 16 wherein said first scoring value is five points, said second scoring value is three points, and said third scoring value is one point.

* * * * *